US009845698B2

(12) United States Patent
Brooks et al.

(10) Patent No.: US 9,845,698 B2
(45) Date of Patent: Dec. 19, 2017

(54) BELLY BAND SEAL WITH ANTI-ROTATION STRUCTURE

(71) Applicant: Siemens Energy, Inc., Orlando, FL (US)

(72) Inventors: Robert T. Brooks, Chuluota, FL (US); Manish S. Gurao, Oviedo, FL (US)

(73) Assignee: Siemens Energy, Inc., Orlando, FL (US)

( * ) Notice: Subject to any disclaimer, the term of this patent is extended or adjusted under 35 U.S.C. 154(b) by 313 days.

(21) Appl. No.: 14/748,271

(22) Filed: Jun. 24, 2015

(65) Prior Publication Data

US 2016/0376902 A1 Dec. 29, 2016

(51) Int. Cl.
*F01D 11/00* (2006.01)

(52) U.S. Cl.
CPC ..... *F01D 11/005* (2013.01); *F05D 2240/55* (2013.01); *F05D 2250/411* (2013.01); *F05D 2260/30* (2013.01)

(58) Field of Classification Search
None
See application file for complete search history.

(56) References Cited

U.S. PATENT DOCUMENTS 7,581,931 B2 9/2009 Shaefer et al.
2006/0239814 A1* 10/2006 Uwami ..... F01D 11/008 415/134
2007/0297900 A1* 12/2007 Abgrall ..... F01D 5/225 415/209.3
2009/0148279 A1* 6/2009 Shaefer ..... F01D 5/06 415/173.5
2009/0191050 A1 7/2009 Nereim et al.
2014/0062032 A1* 3/2014 Wolfe ..... F16J 15/128 277/590
2014/0112766 A1* 4/2014 Nereim ..... F01D 5/06 415/173.7
2014/0119899 A1* 5/2014 Nereim ..... F01D 5/06 415/173.1
2014/0119900 A1* 5/2014 Gurao ..... F01D 5/06 415/173.1
2014/0225334 A1* 8/2014 Kugimiya ..... F01D 11/005 277/637
2014/0255169 A1* 9/2014 Muller ..... F01D 11/003 415/173.7

* cited by examiner

*Primary Examiner* — Dwayne J White
*Assistant Examiner* — Theodore Ribadeneyra

(57) ABSTRACT

A belly band seal for use in a multi-stage turbomachine having plural rotor disks includes a seal strip positionable in a space between a pair of arms defined by opposing portions of adjoining rotors. The seal strip includes opposite edges for locating in respective slots in end faces of said pair of arms. The belly band seal further includes an anti-rotation structure disposed on a radially inner surface of the seal strip. The anti-rotation structure is configured as a cantilever having a pivoted end fixed to the radially inner surface and a free end comprising a radially inwardly extending engagement member for removably positioning in a radial recess in one of the arms. The cantilever is configured so as to urge the engagement member toward the radial recess by spring action. The radial recess is configured to constrain a tangential movement of the engagement member upon being positioned therein.

20 Claims, 4 Drawing Sheets

BELLY BAND SEAL WITH ANTI-ROTATION STRUCTURE

BACKGROUND

1. Field

The present invention relates in general to seals for multistage turbomachines. In particular, embodiments of the present invention relate to an anti-rotation structure for a belly band seal provided between adjoining disks in a multistage turbomachine, and to a method for assembling such a bellyband seal.

2. Description of the Related Art

In various multistage turbomachines used for energy conversion, such as turbines, a fluid is used to produce rotational motion. In a gas turbine, for example, a gas is compressed through successive stages in a compressor and mixed with fuel in a combustor. The combination of gas and fuel is then ignited for generating combustion gases that are directed to turbine stages to produce the rotational motion. The turbine stages and compressor stages typically have stationary or non-rotary components, e.g., vane structures, that cooperate with rotatable components, e.g., rotor blades, for compressing and expanding the operational gases.

The rotor blades are typically mounted to disks that are supported for rotation on a rotor shaft. Annular arms extend from opposed portions of adjoining disks to define paired annular arms. A cooling air cavity is formed on an inner side of the paired annular arms between the disks of mutually adjacent stages, and a labyrinth seal may be provided on the inner circumferential surface of the stationary vane structures for cooperating with the annular arms to effect a gas seal between a path for the hot combustion gases and the cooling air cavity. The paired annular arms extending from opposed portions of adjoining disks define opposing end faces located in spaced relation to each other. This space between the opposing end faces of the adjacent rotor disks is sealed by a seal structure commonly referred to as a "belly band seal". The belly band seal includes a seal strip which bridges the gap between the opposing end faces of the adjoining rotor disks to prevent cooling air flowing through the cooling air cavity from leaking into the path for the hot combustion gases. The seal strip may be formed of multiple segments, in the circumferential direction, that are interconnected at lapped or stepped ends.

When the seal strip comprises plural segments positioned adjacent to each other, in the circumferential direction, under thermal load the seal strip may shift tangentially (i.e., along a circumferential direction) relative to each other. Shifting may cause one end of a seal strip segment to increase the overlap with an adjacent segment, while the opposite end of the seal strip segment will move out of engagement with an adjacent segment, opening a gap for passage of gases through the seal strip. In order to prevent rotation of the seal strip segments, the segments may be provided with anti-rotation structures to cooperate with an adjacent disk surface for holding the segments stationary relative to the disk.

Anti-rotation structures typically constrain the seal strip at the center of the seal strip segment. Known configurations for an anti-rotation structure includes a pin configuration, bend tab configuration, lock-block configuration, u-clip configuration and T-block configuration, among others. Among all of the above configurations, the pin configuration provides relatively high design life, typically about 18,000-50,000 hours. However, a belly band seal having an anti-rotation structure with a pin design can only be installed when the rotor is de-stacked.

SUMMARY

Briefly, aspects of the present invention provide a belly band seal with an anti-rotation structure for use in a turbomachine, a multi-stage turbomachine having a belly band seal with an anti-rotation structure, and a method for assembling a belly band seal having the illustrated anti-rotation structure.

According to a first aspect, a belly band seal for use in a turbomachine is provided. The turbomachine comprises a plurality of stages comprising plural rotor disks, and arms on opposed portions of adjoining rotor disks to define paired arms with a space therebetween, said paired arms comprising respective end faces including slots. The belly band seal comprises a seal strip for positioning in the space between the paired arms, the seal strip being in the shape of a segment of a ring having opposite edges for locating in respective slots of said paired arms and coaxial to the rotor disks. The bellyband seal further comprises an anti-rotation structure disposed on a radially inner surface of the seal strip. The anti-rotation structure is configured as a cantilever having a pivoted end fixed to the radially inner surface of the seal strip and a free end comprising a radially inwardly extending engagement member for removably positioning in a radial recess provided on one of the arms of the paired arms. The cantilever is configured so as to urge the engagement member toward the radial recess by spring action. The radial recess is configured to constrain a tangential movement of the engagement member upon being positioned therein.

According to a second aspect, a multi-stage turbomachine with the inventive belly band seal is provided. The multi-stage turbomachine includes a plurality of rotor disks, comprising arms on opposed portions of adjoining rotor disks that define paired arms with a space therebetween, said paired arms comprising respective end faces including slots. The belly band seal includes a seal strip positioned in the space between the paired arms. The seal strip being in the shape of a segment of a ring having opposite edges located in respective slots of said paired arms. The ring is coaxial to the rotor disks. The belly band seal includes an anti-rotation structure disposed on a radially inner surface of the seal strip. The anti-rotation structure is configured as a cantilever having a pivoted end fixed to the radially inner surface of the seal strip and a free end comprising a radially inwardly extending engagement member removably positioned in a radial recess provided on one of the arms of the paired arms. The cantilever is configured so as to urge the engagement member toward the radial recess by spring action. The radial recess is configured to constrain a tangential movement of the engagement member positioned therein.

According to a third aspect, a method is provided for assembling the inventive belly band seal in a multi-stage turbomachine. The method includes arranging the belly band seal to cover an annular space between a pair of arms formed by opposed portions of adjoining rotor disks of the multi-stage turbomachine by positioning the seal strip such that opposite edges of the seal strip are located in respective slots of said pair of arms. The method further includes moving the seal strip along the slots in a circumferential direction until a final assembly position is reached wherein the engagement member is aligned with a radial recess in one of the arms of the pair of arms, wherein during the movement of the seal strip, the free end of the cantilever is deflected and held in position by a temporary retaining structure to allow passage of the seal strip through the slots. The method further includes, upon reaching the final assembly position, releasing the free end of the cantilever such that the engagement member is urged towards the radial recess and held therein by spring action of the cantilever. The radial recess constrains a tangential movement of the engagement member positioned therein.

BRIEF DESCRIPTION OF THE DRAWINGS

The invention is shown in more detail by help of figures. The figures show preferred configurations and do not limit the scope of the invention.

DETAILED DESCRIPTION

In the following detailed description of the preferred embodiment, reference is made to the accompanying drawings that form a part hereof, and in which is shown by way of illustration, and not by way of limitation, a specific embodiment in which the invention may be practiced. It is to be understood that other embodiments may be utilized and that changes may be made without departing from the spirit and scope of the present invention.

Figure 1:
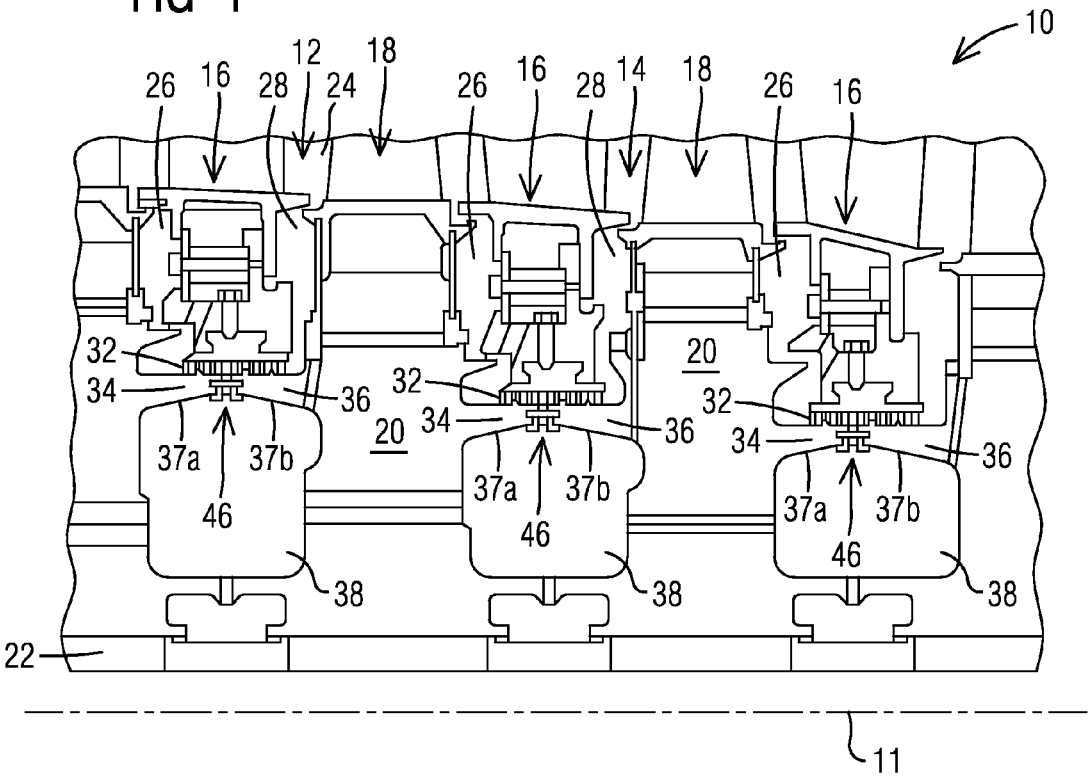
FIG. 1 is diagrammatic section view of a portion of a gas turbine engine.

Referring to FIG. 1, a portion of a turbine engine 10 is illustrated diagrammatically. The turbine engine 10 has an engine axis 11 and includes adjoining stages 12, 14. Each stage 12, 14 comprises at least one row of stationary vane assemblies 16 and at least one row of rotating blades 18. The vane assemblies 16 and blades 18 are positioned circumferentially within the engine 10 with alternating arrays of vane assemblies 16 and blades 18 located in the axial direction of the turbine engine 10. The blades 18 are supported on rotor disks 20 secured to adjacent disks with spindle bolts 22. The vane assemblies 16 and blades 18 extend into an annular gas passage 24, and hot gases directed through the gas passage 24 flow past the vane assemblies 16 and blades 18 to remaining rotating elements.

Disk cavities 26, 28 are located radially inwardly from the gas passage 24. Purge air is preferably provided from cooling gas passing through internal passages in the vane assemblies 16 to the disk cavities 26, 28 to cool blades 18 and to provide a pressure to balance against the pressure of the hot gases in the gas passage 24. In addition, interstage seals comprising labyrinth seals 32 are supported at the radially inner side of the vane assemblies 16 and are engaged with surfaces defined on paired annular disk arms 34, 36 extending axially from opposed portions of adjoining disks 20. An annular cooling air cavity 38 is formed between the opposed portions of adjoining disks 20 on a radially inner side 37*a*, 37*b* of the respective paired annular disk arms 34, 36. The annular cooling air cavity 38 receives cooling air passing through disk passages to cool the disks 20.

The pair of arms 34, 36 of adjoining rotor disks 20 define an annular space or gap therebetween. This gap is bridged by a belly band seal 46, which defines a seal for preventing or substantially limiting flow of gases between the cooling air cavity 38 and the disk cavities 26, 28. The belly band seal 46 essentially includes a seal strip that is formed in the shape of a segment of a ring. Opposing edges of the seal strip are engaged with the arms 34 and 36 of the adjoining rotor disks 20 to seal the annular gap between them. Multiple such segments, typically four, are assembled circumferentially next to each other to form an annular-shaped belly band seal 46. The turbine engine 10 typically includes multiple belly band seals 46 in a plurality of locations along its axis 11, between rotor disks 20 of adjoining stages.

The ends of each of the segments (seal strips) of the belly band seal may be ship-lapped. Under thermal load, the seal strips may shift tangentially (i.e., along a circumferential direction) relative to each other. Shifting may cause one end of a seal strip segment to increase the overlap with an adjacent segment, while the opposite end of the seal strip segment will move out of engagement with an adjacent segment, opening a gap for passage of gases through the seal strip. In order to prevent rotation of the seal strip segments, each of the segments or seal strips may be provided with an anti-rotation structure, located, for example near about the center of the seal strip, which would cooperate with an adjacent disk surface for holding the segments stationary relative to the disk.

Figure 2:
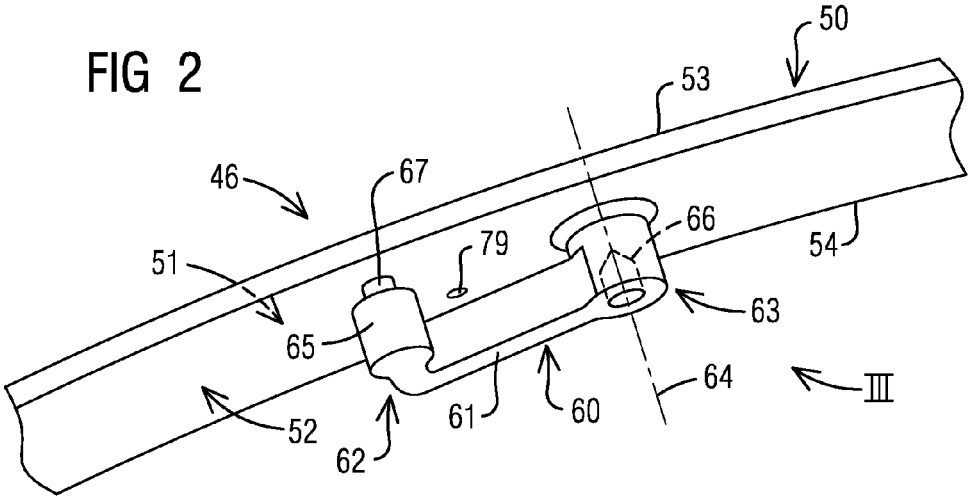
FIG. 2 is a perspective view of a belly band seal with an anti-rotation structure according to a first embodiment.

FIG. 2 illustrates a perspective view of a belly band seal 46 according an example embodiment. The belly band seal 46 is made up of a number of seal strips 50, only one of which is illustrated in the drawing. The seal strip 50 has the shape of a segment of a ring, such that when a plurality of such seal strips 50 are assembled circumferentially next to each other, an annular or ring-shaped belly band seal 46 is produced. The seal strip 50 has a radially outer surface 51 and a radially inner surface 52. The surfaces 51 and 52 are delimited along an axial direction by opposite edges 53 and 54 that extend in a circumferential direction.

The illustrated belly band seal 46 comprises an anti-rotation structure 60, located between the circumferential ends of the seal strip 50. The anti-rotation structure 60 is disposed on the radially inner surface 52 of the seal strip 50 and essentially includes a cantilever 61 having a free end 62 and a pivoted end 63, which is attached to the radially inner surface 52 of the seal strip 50. In an exemplary embodiment, the anti-rotation structure 60 and the seal strip 50 are formed in one piece. For example, the anti-rotation structure 60 and the seal strip 50 may be machined out of a single metal bar, thus avoiding additional weight associated with welding or bolting. An exemplary machining process includes electro discharge machining (EDM). Alternately, the anti-rotation structure 60 may also be disposed on the radially inner surface 52 of the seal strip 50 by joining methods, such as by welding, brazing, bolting or combinations thereof.

The free end 62 of the cantilever 61 includes a radially inwardly extending engagement member 65, which is meant to engage within a corresponding radial recess in one of the arms 34 of a rotor disk 20, as illustrated hereinafter. In the embodiment of FIG. 2, the engagement member 65 is configured as a pin having a generally cylindrical shape. In one embodiment, the dimensions of the pin 65 (e.g., diameter) may correspond to that of a standard factory pin of a conventionally known type of anti-rotation structure. Such a feature provides easy adaptability of the inventive belly band seal to existing turbomachines having standard factory pin design of anti-rotation structures, resulting in minimal modification to its components, such as rotor disks. The factory pin design of the free end 62 of the cantilever 61 also provides high operational life of the belly band seal 46.

In the illustrated embodiment, the pivoted end 63 of the cantilever 61 comprises a recess or a hole 66. The recess or hole 66 provides a region of reduced mass, which results in a lighter weight of the rotating belly band seal 46.

The cantilever 61 of the anti-rotation structure 60 is capable of being deflected, i.e., bent or rotated about a pivot axis 64. In FIG. 2, the cantilever 61 is shown to be in a natural or un-deflected position. When deflected, i.e., bent or rotated about the pivot axis 64, as illustrated in FIG. 3, the cantilever 61 tends to return to its natural position by spring action, resultant from the elasticity of the material of the cantilever 61.

Figure 3:
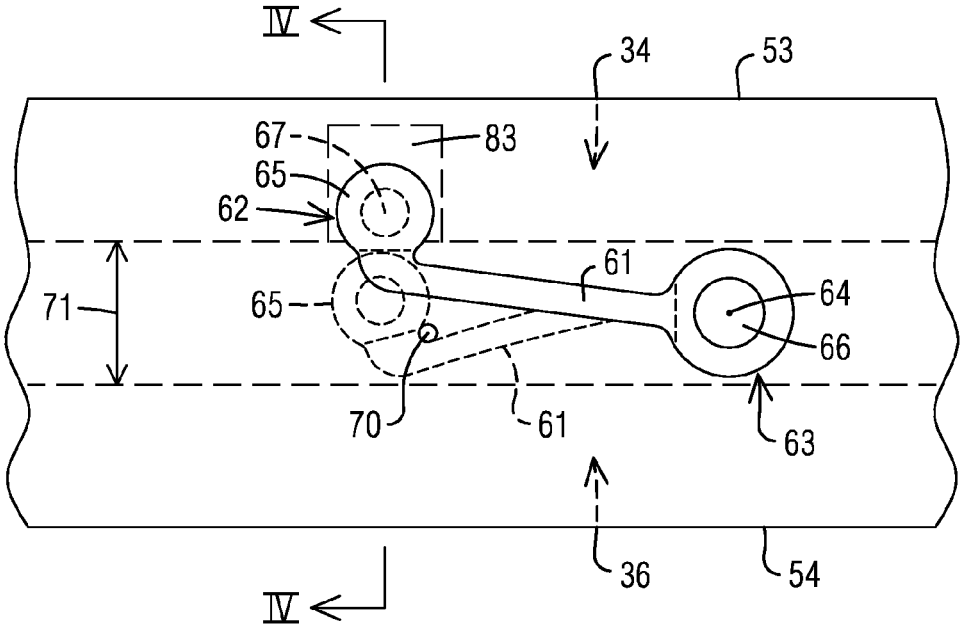
FIG. 3 is a diagrammatic bottom end view of the belly band seal according to the first embodiment.
Figure 4:
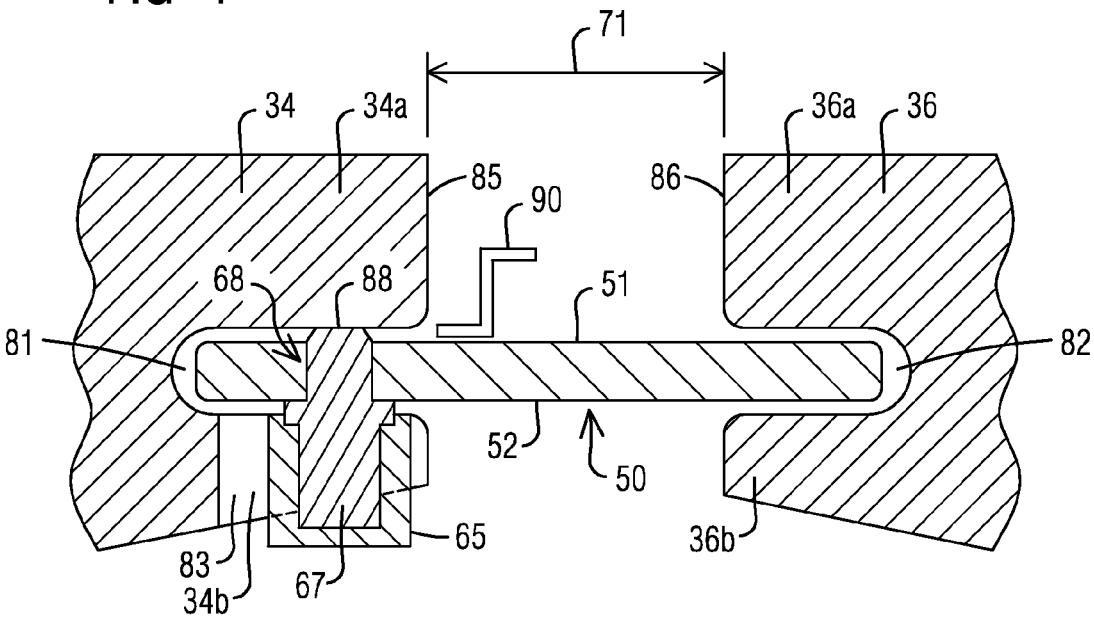
FIG. 4 is a diagrammatic cross-sectional view of the belly band seal along the plane IV-IV of FIG. 3, according to a first configuration of the verification pin.
Figure 5:
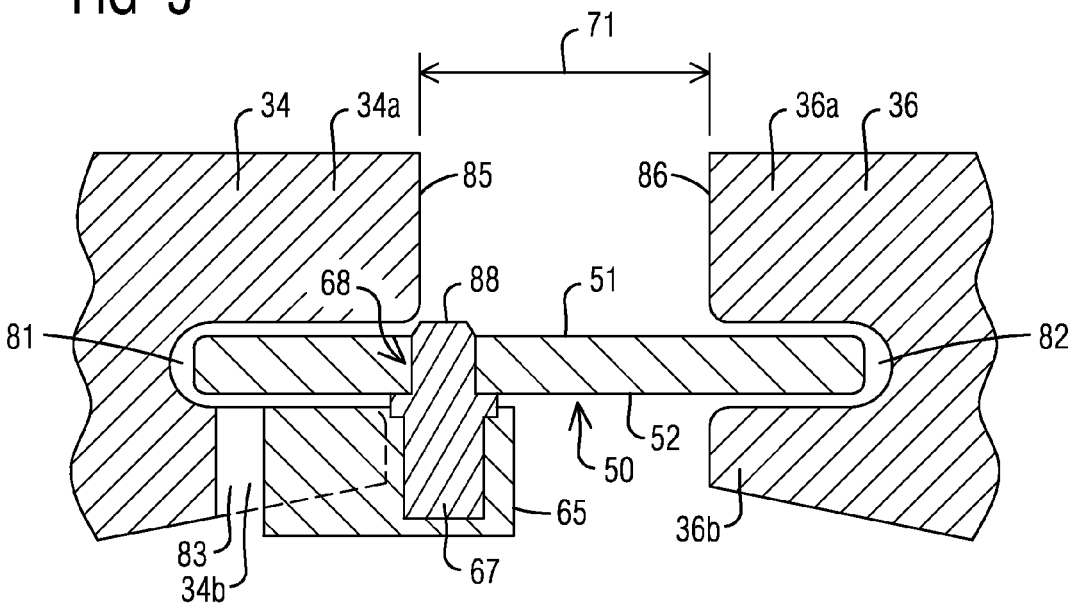
FIG. 5 is a diagrammatic cross-sectional view of the belly band seal along the plane IV-IV of FIG. 3, according to a first configuration of the verification pin.

The assembly of the belly band seal 46 into the turbomachine 10 will now be illustrated referring generally to FIG. 3-5.

FIG. 3 illustrates a bottom view of the belly band seal 46 as seen along a direction III in FIG. 2. In the drawing, the cantilever 61 is shown in two states, namely a deflected state illustrated by dotted lines, and natural or free state illustrated in bold. During assembly of belly band seal 46, the cantilever 61 of the anti-rotation structure is held in a deflected position. In this embodiment, a temporary retaining structure, such as a pin 70, is used for holding the cantilever 61 in the deflected position during the assembly. To this end, the sealing strip 50 may be provided with a hole or a recess 79 to receive the pin 70 (see FIG. 2).

The belly band seal 46 is arranged so as to to cover an annular space between the pair of arms 34, 36 formed by opposed portions of adjoining rotor disks 20 of the multi-stage turbomachine. During the assembly, the cantilever 61 is held in a deflected position by the temporary retaining structure, i.e., the pin 70. The seal strip 50 is then positioned such that opposite edges 53, 54 of the seal strip 50 are located in respective circumferentially extending slots 81, 82 provided in the pair of arms 34, 36. The seal strip 50 is then moved along the slots 81, 82 in a circumferential direction until a final assembly position is reached. During the movement of the seal strip 50, the cantilever 61 remains in the deflected position so as to be located entirely the gap or clearance 71 between the pair of arms 34, 36 of the adjoining rotor disks, which allows the seal strip 50 to be moved unobstructed along the slots.

A final assembly position is said to be reached when the radially inward extending engagement member 65 is aligned with a radial recess 83 in one of the arms, in this case the arm 34. It is to be noted that in FIG. 2, the engagement member 65 extends perpendicularly outward from the plane of the paper. Upon reaching the final assembly position, the cantilever 61 is released from the deflected position by removing the pin 70, upon which the cantilever 61 rotates (clockwise in this example) about the pivot axis 64 to assume its natural state. As a result, the engagement member 65 at the free end 62 of the cantilever 61 is pushed into the radial recess 83 in the arm 34 of the rotor disk and held in place therein by spring action. The radial recess 83 constrains tangential movement of the engagement member 65, and thus prevents rotation of the seal strip 50.

FIG. 4 illustrates a cross-sectional view of the belly band seal 46 in an assembled state. As shown, the seal strip 50 is positioned such that its opposite edges 53 and 54 are located in circumferentially extending slots 81, 82 provided on respective end faces 85, 86 of the arms 34, 36 of adjoining rotor disks. The slot 81 produces a forked structure of the arm 34 defined by a radially inner tongue 34*a* and a radially outer tongue 34*b*. Likewise, the slot 82 of the arm 36 defines a radially inner tongue 36*a* and a radially outer tongue 36*b*. The engagement member 65 of the anti-rotation structure is held in position in the radial recess 83, which is formed through the radially inner tongue 34*a* of one of the arms 34.

In the illustrated embodiment, the engagement member 65 further comprises a verification pin 67 that is configured to be located in a through-opening 68 extending from the radially inner surface 52 through the radially outer surface 51 of the seal strip 50. The through opening 68 is so located on the seal strip 50 that the verification pin 67 snaps into the through-opening 68 when the engagement member is properly positioned in the radial recess 83 of the arm 34. Further, in the illustrated embodiment, upon snapping into through-opening 68, the verification pin protrudes outwardly from a radially outer surface 51 of the seal strip 50 to exhibit a protrusion 88.

The illustrated design allows verification of proper assembly of the anti-rotation structure by visually inspecting the protrusion 88. In an example embodiment, the verification pin 67 may be colored differently from the seal strip 50 to allow easy visual identification of the protrusion 88.

In the embodiment of FIG. 4, the point of the protrusion 88 of the verification pin 67 is located within the slot 81 of the arm 34. In this case, a bore-scope 90 may be used to provide visual access to the protrusion 88.

FIG. 5 illustrates an alternate embodiment, which provides improved visual accessibility of the verification pin 67. In this case, the engagement member 65 is designed to be wider so as to extend beyond the end face 85 of the arm 34, allowing the verification pin 67 to be positioned in the engagement member 65 such that the protrusion 88 is located in the space between the paired arms 34 and 36. The use of a bore-scope may be obviated in this example.

Figure 6:
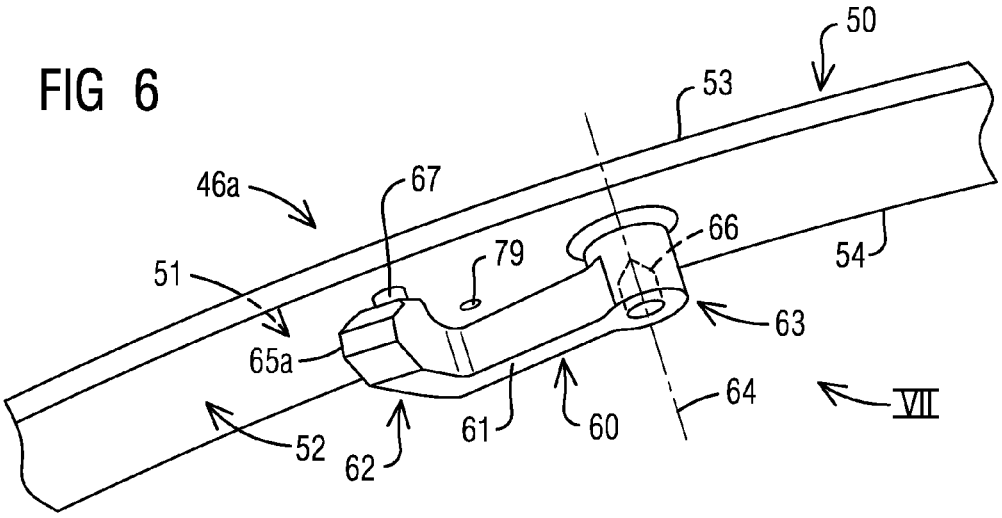
FIG. 6 is a perspective view of a belly band seal with an anti-rotation structure according to a second embodiment.
Figure 7:
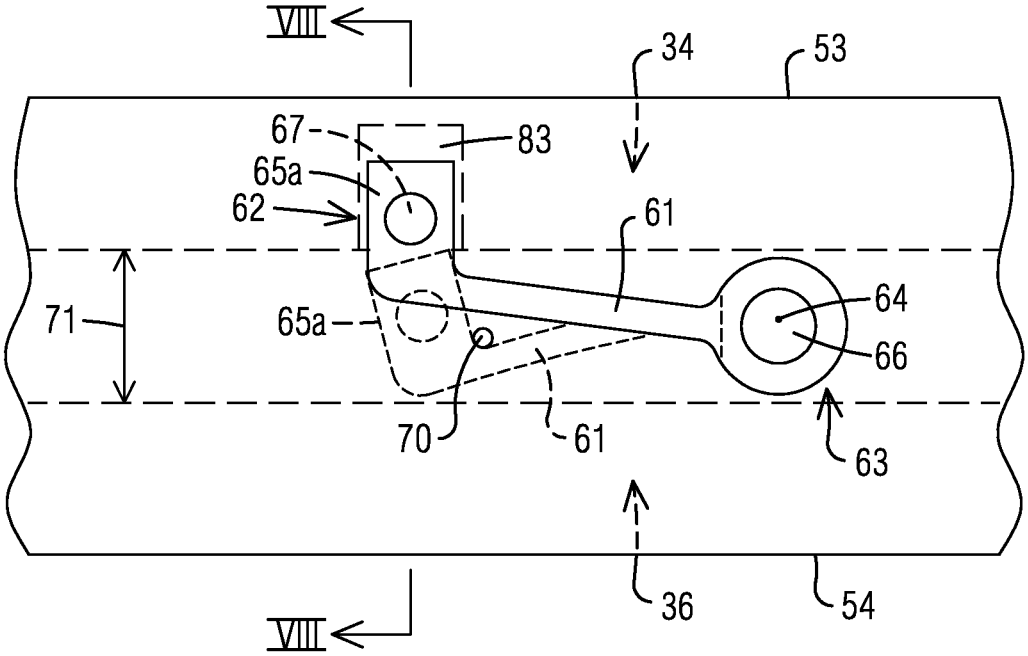
FIG. 7 is a diagrammatic bottom end view of the belly band seal according to the second embodiment.
Figure 8:
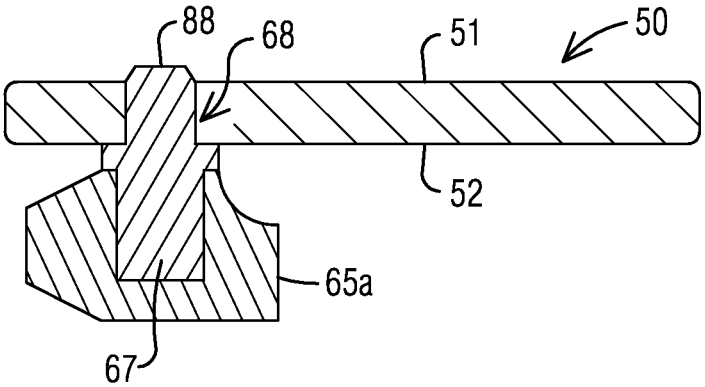
FIG. 8 is a diagrammatic cross-section view of the anti-rotation structure having a verification pin according to the second embodiment.

In the previously illustrated embodiments, the engagement member 65 had a generally cylindrical shape, similar to a conventionally used factory pin. However, the present invention is not limited by the shape and dimension of the engagement member. FIG. 6-8 illustrate an alternate design of the engagement member. FIG. 6 illustrates a perspective view of a belly band seal 46*a* according to this alternate embodiment. FIG. 7 is a bottom view of the belly band seal 46*a* as seen along a direction VII in FIG. 6. FIG. 8 is a cross-sectional view of the anti-rotation structure only along a section VIII-VIII in FIG. 7. As shown therein, the belly band seal 46*a* comprises an the engagement pin 65*a* with a bolted design having a hexagonal shape, preferably with a reduced height to minimize mass. The remaining elements, which are similar or equivalent to those in the embodiments of FIG. 2-6, are designated with like numerals. The description of such elements are not reiterated.

Embodiments of the invention illustrated herein provide a belly band seal with an anti-rotation structure that allows easy on-field assembly without having to de-stack the rotor, while at the same time ensuring that the operational life of the belly band seal is not compromised. Embodiments of the invention also do away with the requirement for welding, brazing or tightening of fasteners on the field. The illustrated embodiments also allow installation with existing field install machining of the turbine disk, and use of existing raw material bar.

While specific embodiments have been described in detail, those with ordinary skill in the art will appreciate that various modifications and alternative to those details could be developed in light of the overall teachings of the disclosure. Accordingly, the particular arrangements disclosed are meant to be illustrative only and not limiting as to the scope of the invention, which is to be given the full breadth of the appended claims, and any and all equivalents thereof.

What is claimed is:

1. A belly band seal for use in a turbomachine having a plurality of stages comprising plural rotor disks, and arms on opposed portions of adjoining rotor disks to define paired arms with a space therebetween, said paired arms comprising respective end faces including slots, the belly band seal comprising:

a seal strip for positioning in said space between said paired arms, the seal strip being in the shape of a segment of a ring having opposite edges for locating in respective slots of said paired arms and coaxial to the rotor disks;

an anti-rotation structure disposed on a radially inner surface of the seal strip, the anti-rotation structure being configured as a cantilever having a pivoted end fixed to the radially inner surface of the seal strip and a free end comprising a radially inwardly extending engagement member for removably positioning in a radial recess provided on one of the arms of the paired arms;

wherein the cantilever is rotatable about a pivot axis and is configured to be in a deflected state during assembly of the seal strip, and in a natural state when a final assembly position is reached;

wherein the cantilever is configured so as to urge the engagement member toward the radial recess by spring action upon reaching of the final assembly position, and wherein the radial recess is configured to constrain a tangential movement of the engagement member upon being positioned therein.

2. The belly band seal according to claim 1, wherein the anti-rotation structure and the seal strip are machined from a metal bar.

3. The belly band seal according to claim 1, wherein the engagement member is a pin having a generally cylindrical shape.

4. The belly band seal according to claim 1, wherein the engagement member has a bolted design comprising a hexagonal shape.

5. The belly band seal according to claim 1, wherein the engagement member further comprises a verification pin that is configured to snap into a through-opening in the seal strip when the engagement member is properly positioned in the radial recess.

6. The belly band seal according to claim 5, wherein upon snapping into the through-opening, the verification pin protrudes outwardly from a radially outer surface of the seal strip.

7. The belly band seal according to claim 6, wherein the point of protrusion of the verification pin is located in the respective slot in the end face of said one of the arms.

8. The belly band seal according to claim 6, wherein the point of protrusion of the verification pin is located in the space between the paired arms.

9. The belly band seal according to claim 1, wherein the pivoted end of the cantilever comprises a region with reduced material defining a recess.

10. The belly band seal according to claim 1, wherein the seal strip comprises a provision for attaching a temporary retaining structure to hold the cantilever in a deflected position to allow unobstructed movement of the belly band seal during its assembly, until a final assembly position is reached.

11. A multi-stage turbmomachine comprising:

a plurality of rotor disks, comprising arms on opposed portions of adjoining rotor disks that define paired arms with a space therebetween, said paired arms comprising respective end faces including slots;

a belly band seal comprising:

a seal strip positioned in said space between said paired arms, the seal strip being in the shape of a segment of a ring having opposite edges located in respective slots of said paired arms, wherein the ring is coaxial to the rotor disks;

an anti-rotation structure disposed on a radially inner surface of the seal strip, the anti-rotation structure being configured as a cantilever having a pivoted end fixed to the radially inner surface of the seal strip and a free end comprising a radially inwardly extending engagement member removably positioned in a radial recess provided on one of the arms of the paired arms;

wherein the cantilever is rotatable about a pivot axis and is configured to be in a deflected state during assembly of the seal strip, and in a natural state when a final assembly position is reached:

wherein the cantilever is configured so as to urge the engagement member toward the radial recess by spring action upon reaching of the final assembly position, and wherein the radial recess is configured to constrain a tangential movement of the engagement member positioned therein.

12. The multi-stage turbomachine according to claim 11, wherein the engagement member further comprises a verification pin snaps into a through-opening in the seal strip when the engagement member is properly positioned in the radial recess.

13. The multi-stage turbomachine according to claim 12, wherein the verification pin protrudes outwardly from a radially outer surface of the seal strip.

14. The multi-stage turbomachine according to claim 13, wherein the point of protrusion of the verification pin is located in the respective slot in the end face of said one of the arms.

15. The multi-stage turbomachine according to claim 13, wherein the point of protrusion of the verification pin is located in the space between the pair of arms.

16. A method for assembling a belly band seal in a multi-stage turbomachine, the bellyband seal comprising a seal strip in the shape of a segment of a ring and an anti-rotation structure disposed on to a radially inner surface of the seal strip, the anti-rotation structure being configured as a cantilever having a pivoted end fixed to the radially inner surface of the seal strip and a free end comprising a radially inwardly extending engagement member, the method comprising:

arranging the belly band seal to cover an annular space between a pair of arms formed by opposed portions of adjoining rotor disks of the multi-stage turbomachine by positioning the seal strip such that opposite edges of the seal strip are located in respective slots of said pair of arms;

moving the seal strip along the slots in a circumferential direction until a final assembly position is reached wherein the engagement member is aligned with a radial recess in one of the arms of the pair of arms, wherein during the movement of the seal strip, the free end of the cantilever is deflected and held in position by a temporary retaining structure to allow unobstructed passage of the seal strip through the slots;

upon reaching the final assembly position, releasing the free end of the cantilever whereby the engagement member is urged towards the radial recess and held therein by spring action of the cantilever;

wherein the radial recess constrains a tangential movement of the engagement member positioned therein.

17. The method according to claim 16, wherein the temporary retention structure is a pin which is removably supported in a pin-hole on the seal strip to hold the cantilever in the deflected position during the movement of the seal strip.

18. The method according to claim 16, wherein the engagement member further comprises a verification pin that is configured to snap into a through-opening in the seal strip when the engagement member is properly positioned in the radial recess, wherein the method further comprises verifying that the engagement member is properly positioned in the radial recess by inspecting if the verification pin has snapped into positioned into the through-opening in the seal strip.

19. The method according to claim 18, wherein upon snapping into through-opening, the verification pin protrudes outwardly from a radially outer surface of the seal strip, wherein the method of verifying comprises visually inspecting the protrusion of the verification pin to determine if the verification pin has snapped into position in the through-opening.

20. The method according to claim 19, comprising using a bore-scope to visually access the point of protrusion of the verification pin.

* * * * *